US005416491A

United States Patent [19]

Nishikawa et al.

[11] Patent Number: 5,416,491

[45] Date of Patent: May 16, 1995

[54] AUTOMOTIVE WINDOW GLASS ANTENNA

[75] Inventors: Kazuya Nishikawa; Junichiro Ieiri; Shingo Tadokoro; Tokio Tsukada; Tohru Hirotsu; Hiroyuki Fujii, all of Matsusaka, Japan

[73] Assignee: Central Glass Company, Limited, Yamaguchi, Japan

[21] Appl. No.: 8,934

[22] Filed: Jan. 26, 1993

[30] Foreign Application Priority Data

Jan. 31, 1992 [JP] Japan ..... 4-016689
Feb. 24, 1992 [JP] Japan ..... 4-036668

[51] Int. Cl.[6] ..... H01Q 1/32
[52] U.S. Cl. ..... 343/713; 343/704
[58] Field of Search ..... 343/704, 713; H01Q 1/32

[56] References Cited

U.S. PATENT DOCUMENTS

| | | | |
|---|---|---|---|
| 4,260,989 | 4/1981 | Ishii et al. | 343/713 X |
| 4,439,771 | 3/1984 | Kume et al. | 343/713 X |
| 4,727,377 | 2/1988 | Yotsuya et al. | 343/713 |
| 5,101,212 | 3/1992 | Shinnai et al. | 343/713 |
| 5,185,612 | 2/1993 | Tsukada et al. | 343/713 |
| 5,220,336 | 6/1993 | Hirotsu et al. | 343/713 |
| 5,229,780 | 7/1993 | Hirotsu et al. | 343/713 |
| 5,334,989 | 8/1994 | Nagayama et al. | 343/713 |

FOREIGN PATENT DOCUMENTS

| | | | |
|---|---|---|---|
| 0222302 | 10/1986 | Japan | H01Q 1/32 |
| 62-37475 | 2/1987 | Japan . | |
| 0175002 | 7/1987 | Japan | H01Q 1/32 |
| 63-43403 | 2/1988 | Japan . | |
| 0032701 | 2/1989 | Japan | H01Q 1/32 |
| 0218202 | 8/1990 | Japan | H01Q 1/32 |
| 0184401 | 8/1991 | Japan | H01Q 1/32 |
| 2184292 | 6/1987 | United Kingdom | H01Q 1/32 |

*Primary Examiner*—Donald Hajec
*Assistant Examiner*—Steven Wigmore
*Attorney, Agent, or Firm*—Keck, Mahin & Cate

[57] ABSTRACT

An antenna is attached to a rear window glass of an automobile and arranged in a space between a defogging heater element and a lower edge of the window glass. According to an aspect of the present invention, the antenna comprises a plurality of horizontal conductive strips having the length of $0.02\lambda \cdot f^{\frac{1}{2}}$ $(1 \pm 0.2)$, adjacent two of which are connected at opposite ends so as to constitute a rectangular loop. The number of the horizontal conductive strips is in the range of 2 to 4. According to another aspect of the present invention, the antenna comprises a main element having two horizontal conductive strips and a vertical strip connecting the horizontal strips at one ends located nearer to a widthwise center of the space, and an auxiliary element having a conductive strip made up of a vertical portion extending upward from upper one of the horizontal conductive strips of the main element to have an upper end and a horizontal portion extending between the upper end of the vertical portion and a feed point located at a widthwise marginal area of the space.

3 Claims, 6 Drawing Sheets

AUTOMOTIVE WINDOW GLASS ANTENNA

BACKGROUND OF THE INVENTION

1. Field of the Invention

The present invention relates to an antenna installed in or on a window glass of an automobile for receiving a radio frequency signal from a portable radio transmitter for controlling the operation of an automotive equipment such as a keyless entry system for automatically unlocking a vehicle door, a similar control system for a luggage compartment lid, a control system for controlling turning on and off of a passenger compartment lamp, etc.

2. Disclosure Information

A keyless entry system for automatically unlocking a vehicle door by receiving a radio frequency signal of a frequency around 50 MHz, 100 MHz, 250 MHz or 300 MHz emitted from a radio transmitter has lately come to attract considerable attention.

In a keyless entry system disclosed in Japanese Provisional Patent Publication No. 62-37475, a pick-up consisting of a loop coil built in a vehicle pillar is used as an antenna. A problem of such a prior art antenna is that it is largely influenced by noise. Another problem is that the antenna is embedded in a vehicle body so that its tuning cannot be attained with ease.

A glass antenna consisting of conductive strips formed on a lower marginal portion of a side window glass by screen printing has been proposed for use in such a keyless entry system as disclosed in Japanese Provisional Publication No. 63-43403. A problem of this glass antenna is that opening and closing of the window causes variations of its gain so that during opening of the window the gains in some directions become so small as to cause malfunction of the keyless entry system.

SUMMARY OF THE INVENTION

According to an aspect of the present invention, there is provided a novel and improved antenna which is attached to a vehicle rear window glass for receiving a radio wave of a frequency f (MHz) and a wavelength λ. The window glass is provided with a defogging heater element so as to leave a space between the heater element and the lower edge of the window glass. The antenna is arranged in the above mentioned space and comprises a plurality of horizontal conductive strips having the length within the range of $0.02\lambda \cdot f^{\frac{1}{2}}$ $(1 \pm 0.2)$, a plurality of vertical conductive strips, adjacent two of the horizontal conductive strips being connected at opposite ends by the vertical conductive strips so as to constitute a rectangular loop, and a feed point located in an area of the above mentioned space between a lateral edge and a widthwise center of the window glass and electrically connected with the horizontal conductive strips, the number of the horizontal conductive strips being in the range of two to four.

According to another aspect of the present invention, there is provided a novel and improved antenna which is attached to a vehicle rear window glass for receiving radio waves. The window glass is provided with a defogging heater element so as to leave a space between the defogging heater element and the lower edge of the window glass. The antenna is arranged in the above mentioned space and comprises a main element located in an area of the space between a lateral edge and a widthwise center of the window glass and having two horizontal conductive strips and a vertical conductive strip connecting ends of the horizontal conductive strips, a feed point located in an area of the above mentioned space between a lateral edge and a widthwise center of the window glass, and an auxiliary element having a conductive strip made up of a vertical portion extending upward from upper one of the horizontal conductive strips of the main element to have an upper end and a horizontal portion extending between the upper end of the horizontal portion and the feed point.

The above structures are effective for solving the above noted problems inherent in the prior art automotive glass antennas.

It is accordingly an object of the present invention to provide a novel and improved glass antenna for an automobile which can attain an improved directivity and an improved gain in any direction.

It is another object of the present invention to provided a novel and improved glass antenna of the above described character which is particularly suited for use in a keyless entry system for automobiles.

It is a further object of the present invention to provide a novel and improved glass antenna of the above described character which can be used as a subsidiary antenna for receiving FM broadcast waves or TV broadcast waves.

DETAILED DESCRIPTION OF THE PREFERRED EMBODIMENTS

Before describing the preferred embodiments in detail, the present invention will be described briefly. An important feature of the present invention resides in the discovery of a mathematical expression used for obtaining an optimal length of an antenna with respect to radio waves of frequencies of 50 MHz, 100 MHz, 250 MHz and 300 MHz. In this connection, it is usually considered that the resonant length of an antenna is obtained from the expression of $(\frac{1}{4}) \cdot \lambda\alpha$ where λ is the wavelength and α is a wavelength compacting ratio (about 0.7) of glass and therefore the optimal length of antenna is around 0.17λ. However, by various experiments conducted by the applicants it was revealed that the resonant length was not always obtained by the above expression but caused to vary depending on variations of the frequency of the wave, that is, the optimal length of the antenna with respect to the radio waves of the frequencies of 300 MHz, 250 MHz and 100 MHz were 350 mm, 380 mm and 600 mm, respectively and therefore the optimal length was proportional to $f^{\frac{1}{2}}$ where f is the frequency of the wave and the proportional constant was 0.02λ. Accordingly, by permitting a little allowance, the optimal length can be obtained from $0.02\lambda \cdot f^{\frac{1}{2}}$ $(1 \pm 0.2)$, that is, the optimal lengths of the antenna with respect to the waves of the frequencies of 300 MHz (1=1000 mm), 250 MHz (1=1200 mm), 100 MHz (1=3000 mm) and 50 MHz (1=6000 mm) are 350±70 mm, 380±76 mm, 600±120 mm and 850±170 mm. It was also found that an antenna consisting of a plurality of horizontal conductive strips of such length and of the number in the range of 2 to 4, adjacent two of the conductive strips being connected by vertical strips to constitute a rectangular loop, could improve the directivity and increase the gain with respect to a radio wave from any direction.

Figure 1:
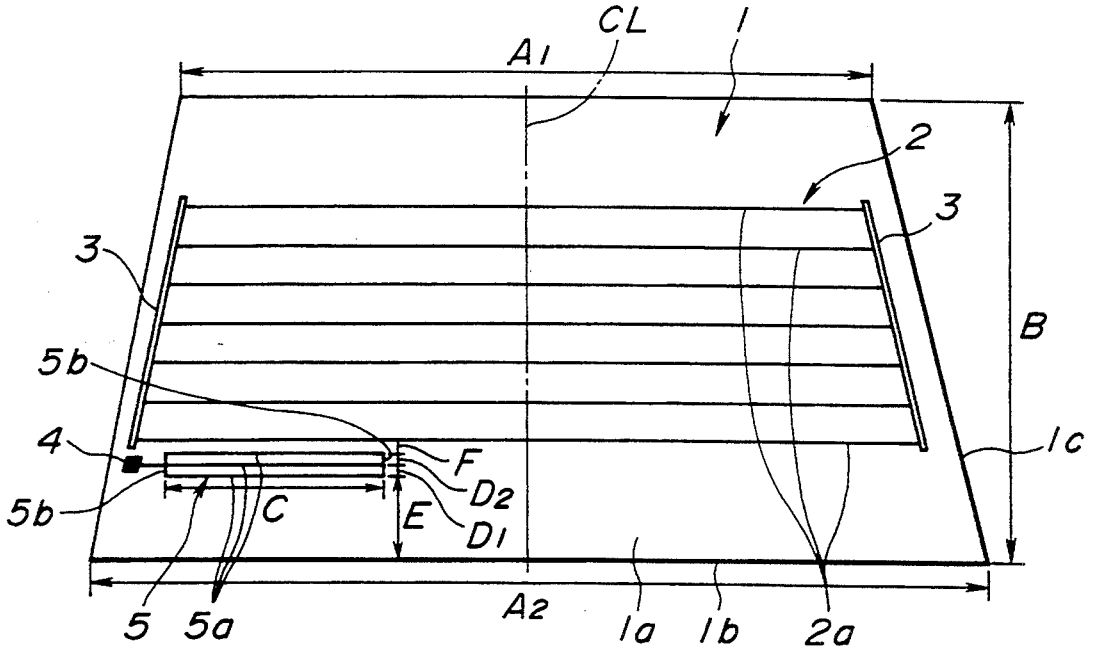
FIGS. 1 to 10 are front views of various embodiments of a glass antenna for an automobile according to the present invention.

Referring now to FIG. 1, a rear window glass 1 of an automobile has on an inboard surface thereof a defogging electric heater element 2 consisting of a plurality of heating strips 2*a* and bus bars 3, and an antenna 5. The window glass 1 is provided with the defogging heater element 2 so as to leave a space 1*a* between the defogging heater element 2 and the lower edge 1*b* of the window glass 1.

The antenna 5 is arranged in the above mentioned space 1*a* and more specifically in the area of the space between one lateral edge 1*c* of the window glass 1 and a widthwise center "CL" of the space 1*a*. The antenna 5 consists of a feed point 4 and three horizontal conductive strips 5*a*. The conductive strips 5*a* are connected at opposite ends by vertical conductive strips 5*b* to constitute two rectangular loops which are vertically continuous to each other, i.e., adjacent two of the conductive strips are connected at opposite ends by vertical conductive strips to constitute a rectangular loop. The antenna 5, heating strips 2 and bus bars 3 are formed by screen-printing an electric conductive paste on the glass plate 1 and baking the paste.

Figure 11:
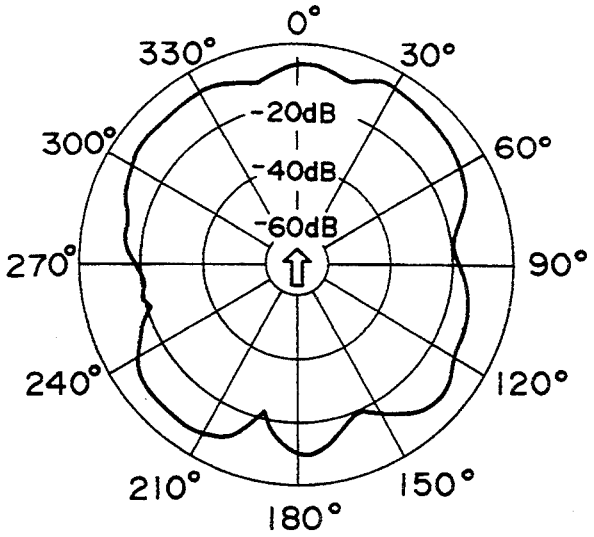
FIGS. 11 and 12 are directivity characteristic distribution diagrams of the glass antennas of FIGS. 1 and 2, respectively.

The various parts of the antenna 5 have such dimensions that A1=1130 mm, A2=1330 mm, B=710 mm, C=380 mm, D1=D2=10 mm, E=75 mm and F=10 mm. With such an antenna 5, its directivity characteristics were measured by measuring the gains in various directions with respect to an FM wave of a frequency of 250 MHz and having a horizontal plane of polarization and expressed by the difference in gain between the antenna of this embodiment and a standard dipole antenna on the assumption that the gain of the standard dipole antenna is zero (hereinafter the difference will be referred to as a dipole ratio), to represent the directivity characteristic. The result of the directivity characteristic is shown in FIG. 11. As seen from FIG. 11, all the gains measured every 5 degrees (i.e., in the seventy-two directions) are larger than −25 dB, and the average gain in the seventy-two directions is −11.8 dB. Since the gain necessary for automatic unlocking of an automotive door or for similar automatic control of other automotive equipment is about −25 dB, the antenna of this embodiment can operate them properly by receiving a radio frequency signal from any direction.

Figure 2:
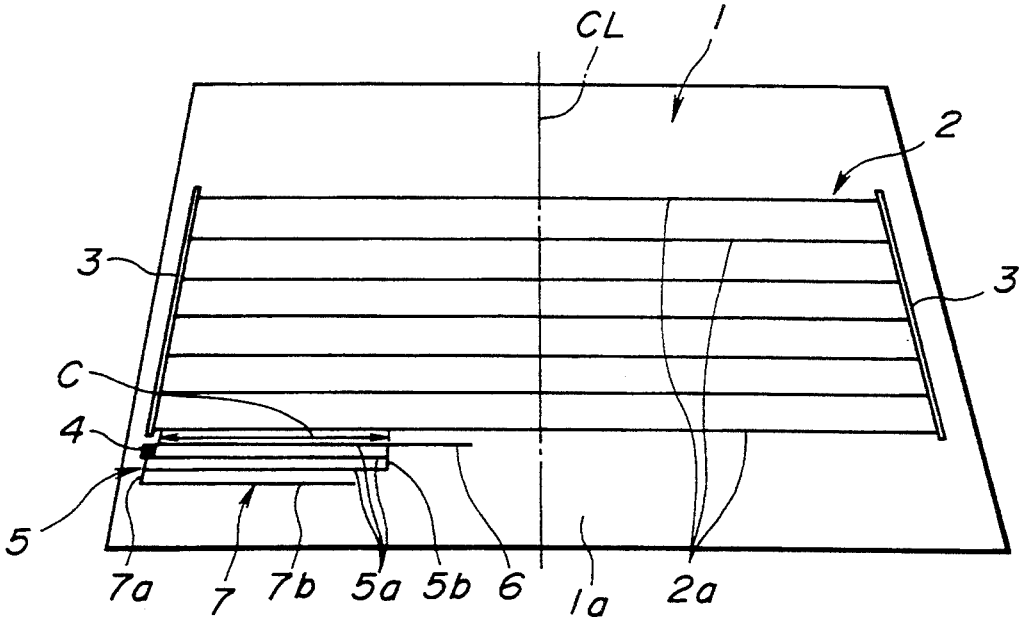

FIG. 2 shows another embodiment which is substantially similar to the previous embodiment of FIG. 1 except that the length "C" of the three horizontal conductive strips 5*a* is 350 mm and adapted to constitute a main element and that an auxiliary element consisting of a first horizontal conductive strip 6 of the horizontal length of 100 mm and a second conductive strip 7 of the horizontal length of 290 mm is additionally provided. The conductive strip 6 of the auxiliary element extends from the uppermost horizontal conductive strip 5*a* toward the widthwise center "CL" of the window glass 1, whilst the conductive strip 7 of the auxiliary element is made up of a vertical portion 7*a* extending downward from the feed point 4 to have a lower end and a horizontal portion 7*b* extending from the lower end of the vertical portion 7*a* toward the widthwise center "CL" of the window glass 1 or the space 1*a*.

Figure 12:
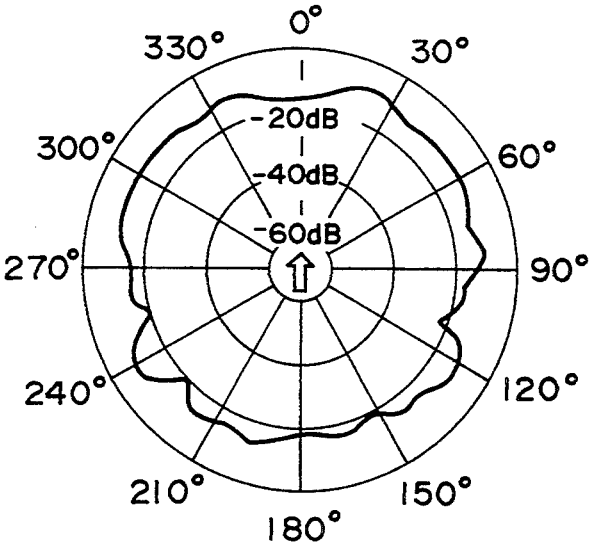

With such an automotive glass antenna, the gains in various directions with respect to an FM wave of a frequency of 300 MHz and having a horizontal plane of polarization were measured and expressed by the above mentioned dipole ratio to represent the directivity characteristic. The result of the directivity characteristic is shown in FIG. 12. As will be apparent from FIG. 12, all of the gains every five degrees (i.e., in the seventy-two directions) are larger than −25 dB, and the average gain in the seventy-two directions is −14.0 dB. This embodiment thus can function properly with respect to a radio wave from any direction for controlling, for example, automatic unlocking of an automotive door, similarly to the previous embodiment of FIG. 1.

Figure 3:
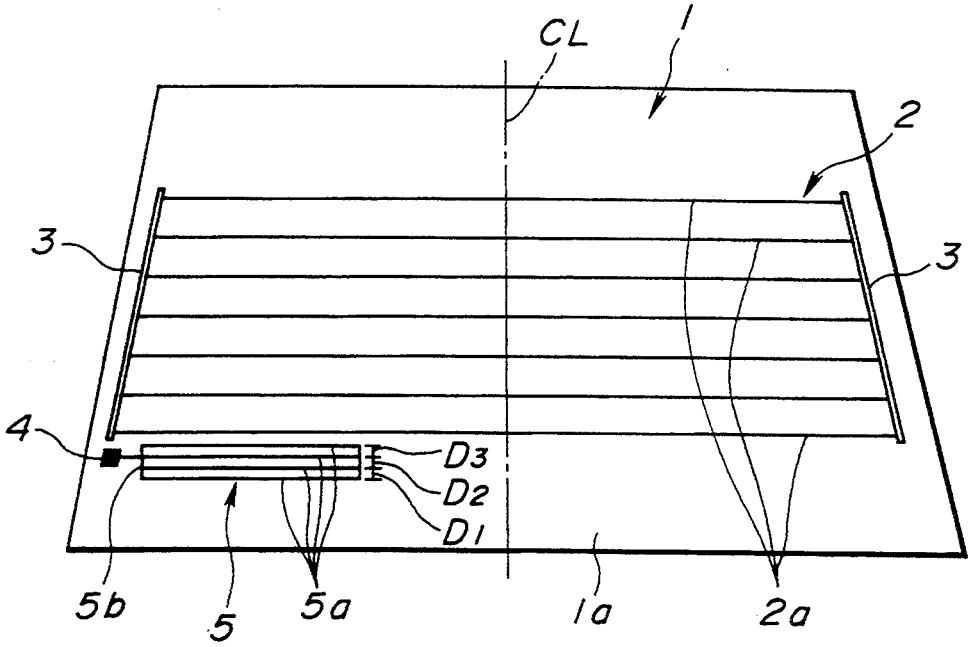

FIG. 3 shows a further embodiment which differs from the previous embodiment of FIG. 1 in that the antenna 5 consists of four horizontal antenna strips 5*a* which are arranged so that D1=D2=D3=10 mm.

Figure 4:
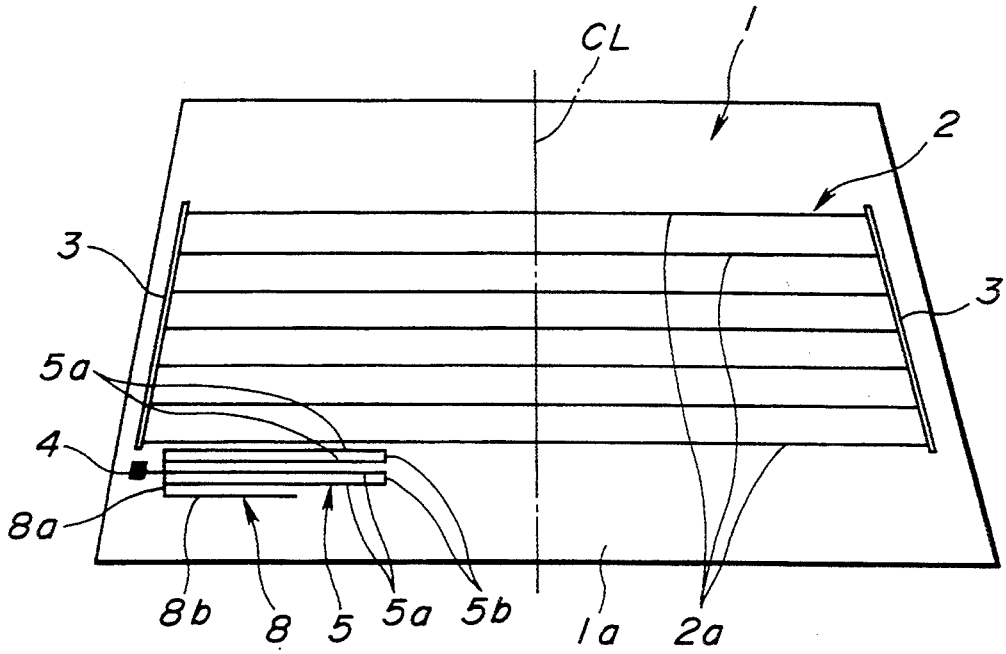

FIG. 4 shows a further embodiment which differs from the previous embodiment of FIG. 3 in that the inner two strips 5*a* are opened, i.e., not connected at one ends so as to constitute two independent rectangular loops of a main element and that an auxiliary element 8 is additionally provided and made up of a vertical portion 8*a* extending downward from the feed point 4 to have a lower end and a horizontal portion 8*b* extending from the lower end of the vertical portion 8*a* toward a widthwise center "CL" of the window glass 1 or the space 1*a*. Except for the above, the embodiments of FIGS. 3 and 4 are structured similarly to the previous embodiment of FIG. 1.

With such glass antennas 5 of FIGS. 3 and 4, the gains in various directions were measured with respect to an FM wave of a frequency of 250 MHz and having a horizontal plane of polarization and expressed by the aforementioned dipole ratio to represent the directivity characteristics. The result of the directivity characteristic of the embodiment of FIG. 3 was such that the average of the gains in the seventy-two directions was −12.4 dB and the minimum gain was −24.4 dB. The result of the directivity characteristic of the embodiment of FIG. 4 was such that the average of the gains in the seventy-two directions was −12.9 dB and the minimum gain was −21.5 dB. Accordingly, the both embodiments of FIGS. 3 and 4 can function properly with respect to a radio wave from any direction and therefore can produce the same effect with the embodiment of FIG. 1.

Figure 5:
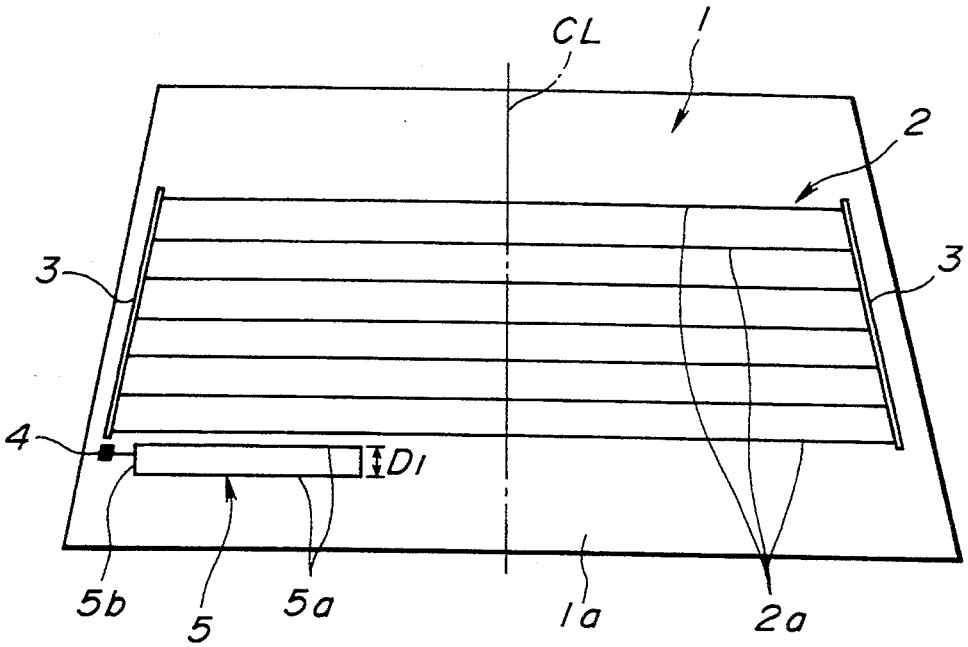

FIG. 5 shows a further embodiment which differs from the previous embodiment of FIG. 1 in that two horizontal conductive strips 5*a* are provided and connected by vertical strips 5*b* at opposite ends constitute a rectangular loop and that D1=35 mm.

With such a glass antenna, the gains in various directions were measured with respect to an FM wave of a frequency of 300 MHz and having a horizontal plane of polarization and expressed by the aforementioned dipole ratio to represent the directivity characteristic. The result of the directivity characteristic was such that the average of the gains in the seventy-two directions was −14.3 dB and the minimum gain was −23.7 dB. Accordingly, this embodiment can function properly with respect to a radio wave from any direction and thus can produce substantially the same effect to the embodiment of FIG. 2. Further, with respect to an FM wave of a frequency of 250 MHz, this embodiment can produce substantially the same effect to the embodiment of FIG. 1.

Figure 6:
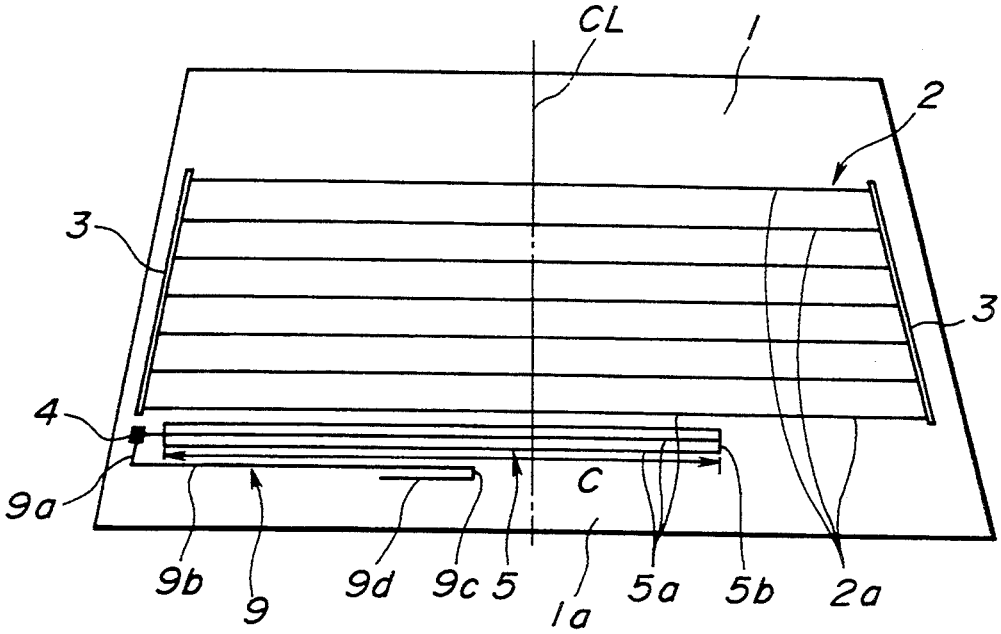

FIG. 6 shows a further embodiment in which three horizontal antenna strips are provided and sized in horizontal length C to be 840 mm and an auxiliary element 9 is additionally provided and consists of a conductive strip made up of a first vertical portion 9*a* extending downward from the feed point 4 to have a lower end, a first horizontal portion 9*b* extending from the lower end of the first vertical portion 9*a* toward a widthwise center of the space 1*a* to have an inner end, a second vertical portion 9*c* extending downward from the inner end of the first horizontal portion 9*b* to have a lower end and a second horizontal portion 9*d* extending from the lower end of the second vertical portion 9*c* toward the marginal area of the space 1*a* where the feed point 4 is located.

Except for the above, this embodiment is substantially similar to the previous embodiment of FIG. 1.

With such an antenna of FIG. 6, the gains in various directions were measured with respect to an FM wave of a frequency of 50 MHz and having a horizontal plane of polarization and expressed by the aforementioned dipole ratio to represent the directivity characteristic. The result of the directivity characteristic was such that the average of the gains in the seventy-two directions was −14.3 dB and the minimum gain was −23.7 dB. Accordingly, this embodiment can function properly with respect to a radio wave from any direction.

Before describing embodiments of FIGS. 7 to 10, another important feature of this invention will be described briefly. Another important feature of this invention resides in the discovery that two horizontal conductive strips connected by a vertical strip at one ends and arranged in an area between a lateral end and a widthwise center of a window glass can increase the gains in all directions and are thus suited for use as a main element of an antenna, and that a combination of arrangement of a feed point in a widthwise marginal area of a window glass and provision of an auxiliary element made up of a conductive strip having a vertical portion and a horizontal portion and adapted to serve as a leading line for connection between the feed point and the main element is effective for making up a drop of gain of the main element in a particular direction for thereby improving the gains in all directions.

Figure 7:
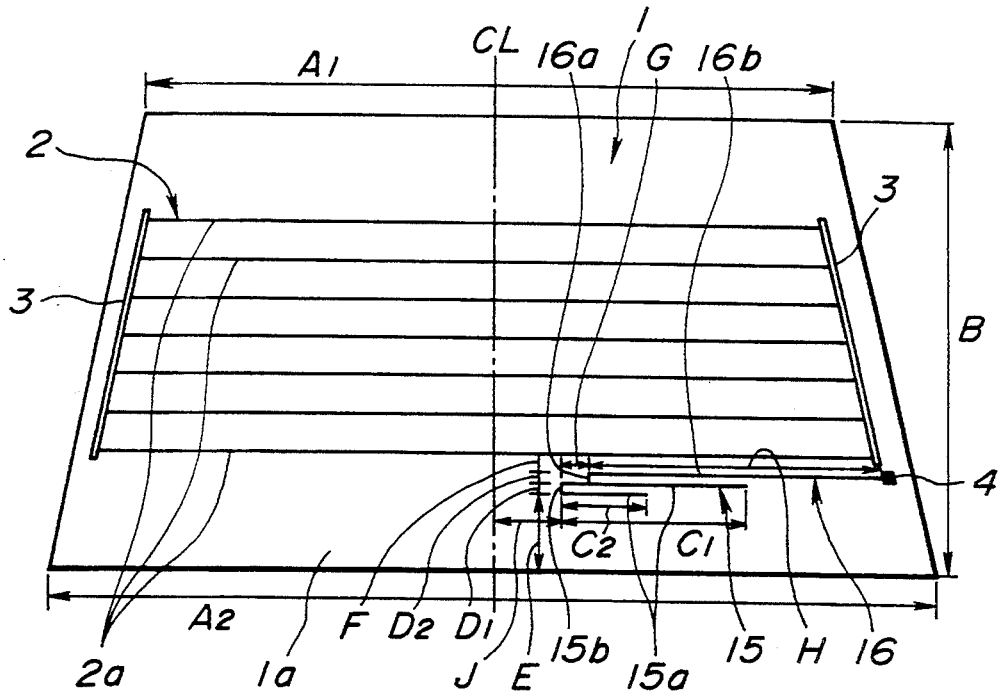

Referring to FIG. 7, an antenna consisting of a feed point 4, a main element 15 and an auxiliary element 16 is arranged in an area of the space 1*a* extending between a lateral edge of the window glass 1 and the widthwise center "CL" of the window glass 1 or the space la. The main element 15 is made up of two horizontal conductive strips 15*a* connected at one ends by a vertical strip 15*b* to constitute a T-shaped joint portion. The auxiliary element 16 is made up of a conductive strip having a vertical portion 16*a* connected to upper one of the conductive strips 15*a* of the main element 15 and extending upward therefrom to have an upper end and a horizontal portion 16*b* extending between the upper end of the vertical portion 16*a* and the feed point 4. The joint between the vertical portion 16*a* of the auxiliary element 16 and upper one of the conductive strips 15*a* of the main element 15 is spaced a predetermined distance "G" from the above described one end of the upper horizontal conductive strip 15*a* of the main element 15. Various parts of the antenna have such dimensions that A1=1050 mm, A2=1500 mm, B=600 mm, C1=300 mm, C2=150 mm, D1=D2=10 mm, H=560 mm, G=50 mm, E=60 mm, F=20 mm, and J=100 mm.

With the antenna of FIG. 7, the gains in various directions were measured with respect to a FM wave of a frequency of 250 MHz and having a horizontal plane of polarization and expressed by the aforementioned dipole ratio to represent the directivity characteristic. The result of the directivity characteristic was such that the average of the gains in the seventy-two directions was −14.0 dB and the minimum gain was −24.1 dB. Accordingly, this embodiment can function properly with respect to a radio wave from any direction similarly to the previous embodiments of FIGS. 1 to 6.

Figure 8:
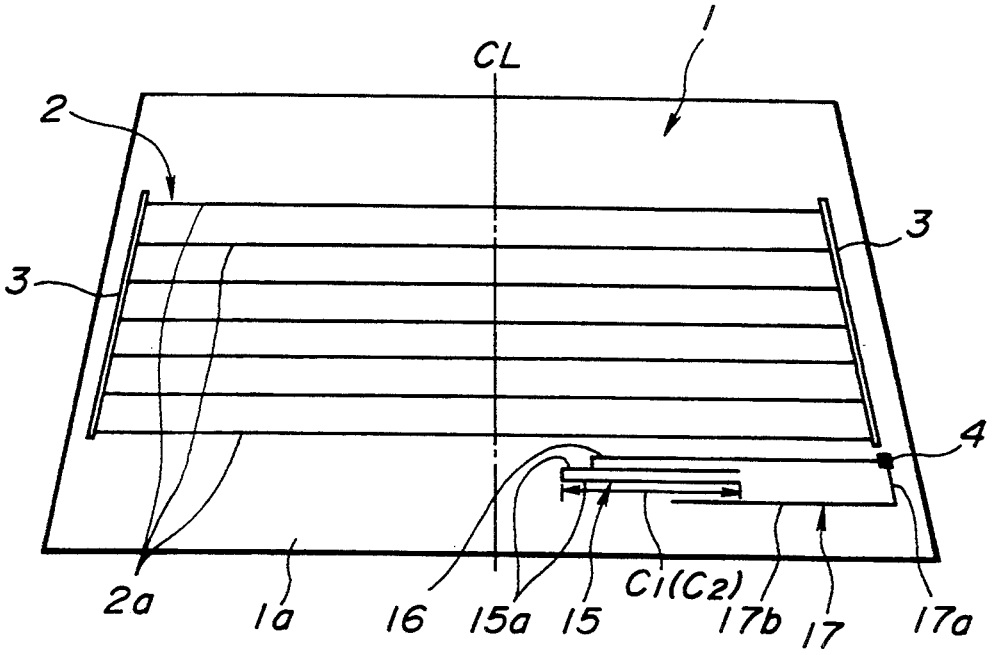

FIG. 8 shows a further embodiment which is substantially similar to the previous embodiment of FIG. 7 except that the horizontal lengths C1, C2 of the two horizontal conductive strips 15*a* of the main element 15 are equal to each other and 300 mm, and that an auxiliary element 17 is additionally provided and made up of a conductive strip having a vertical portion 17*a* extending downward from the feed point 4 to have a lower end and a horizontal portion 17*b* extending from the lower end of the vertical portion 17*a* toward the widthwise center "CL" of the window glass 1 or the space 1*a*.

With such an automotive antenna system of FIG. 8, the gains in various directions were measured with respect to an FM wave of a frequency of 250 MHz and having a plane of polarization and expressed by the aforementioned dipole ratio to represent the directivity characteristic. The result of the directivity characteristic was such that the average of the gains in the seventy-two directions was −12.4 dB and the minimum gain was −24.4 dB. Accordingly, the antenna of this embodiment can function properly with respect to a radio wave from any direction and therefore can produce substantially the same effect to the previous embodiment of FIG. 7.

Figure 9:
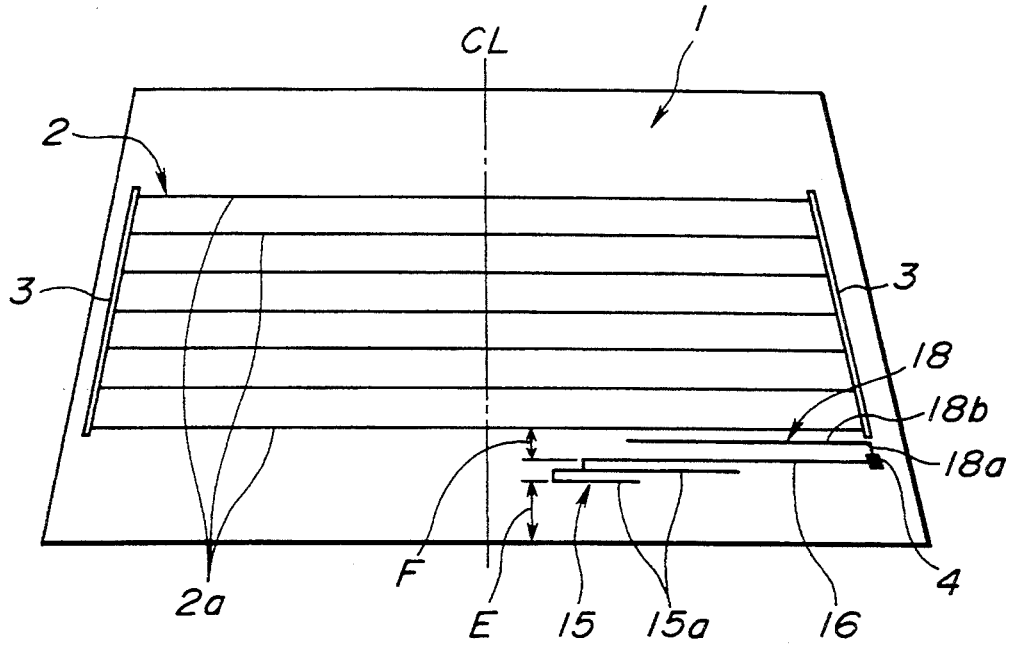

FIG. 9 shows a further embodiment which is substantially similar to the previous embodiment of FIG. 7 except that the horizontal conductive strips 15*a* of the main element 15 are disposed upside down, i.e., in such a manner that the longer one is placed in an upper position, that E=50 mm and F=30 mm, and that an auxiliary element 18 is additionally provided and made up of a conductive strip having a vertical portion 18*a* extending upward from the feed point 4 to have an upper end and a horizontal portion 18*b* located above the main element 15 and extending from the upper end of the vertical portion 18*a* toward the widthwise center "CL" of the window glass 1 or the space 1*a*.

With such an antenna of FIG. 9, the gains in various directions were measured with respect to an FM wave of a frequency of 250 MHz and having a horizontal plane of polarization and expressed by the aforementioned dipole ratio to represent the directivity characteristic. The result of the directivity characteristic was such that the average of the gains in the seventy-two directions was −13.0 dB and the minimum gain was −23.8 dB. Accordingly, the antenna of this embodiment can function properly with respect to a radio wave from any the direction and thus can produce substantially the same effect to the previous embodiment of FIG. 7.

Figure 10:
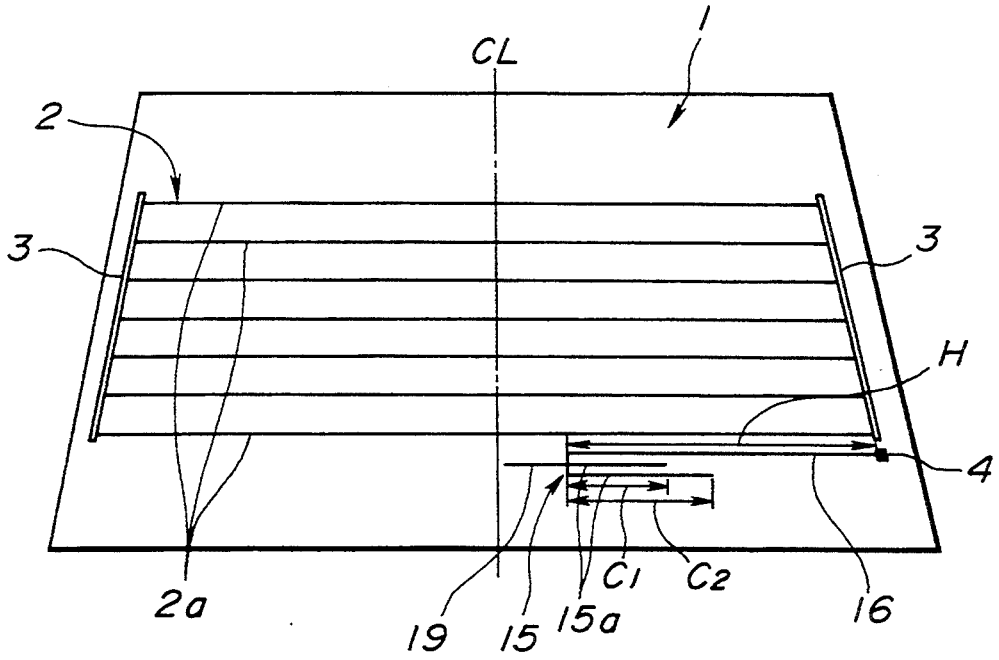

FIG. 10 shows a further embodiment which is substantially similar to the embodiment of FIG. 7 except that the horizontal lengths C1, C2 of the main element 15 are respectively 150 mm and 250 mm, that the joint between the vertical portion 16*a* of the auxiliary element 16 and the upper horizontal conductive strip 15*a* of the main element 15 is located at the above described one end of the upper conductive strip of the main element for connection with the lower horizontal conductive strip 15*a* of same so that H=610 mm, and that an auxiliary element 19 is additionally provided and consists of a horizontal conductive strip of the length of 100 mm and extending from the above described one end of the upper horizontal conductive strip of the main element 15, i.e., the end for connection with the lower horizontal conductive strip 15*a* by way of the vertical strip 15*b* , toward the widthwise center "CL" of the window glass 1 or the space 1*a*.

With such an antenna system of FIG. 10, the gains in various directions were measured with respect to an FM wave of a frequency of 250 MHz and having a horizontal plane of polarization and expressed by the aforementioned dipole ratio to represent the directivity characteristic. The result of the directivity characteristic was such that the average of the gains in the seventy-two directions was −13.5 dB and the minimum gain was −24.7 dB. This embodiment thus can operate properly with respect to a radio wave from any direction and therefore can produce substantially the same effect to the previous embodiment of FIG. 7.

While the present invention has been described and shown as above, various modifications and variations may be made thereto.

For example, with regard to the embodiments of FIGS. 1 to 6, the distances D1, D2, D3 between the horizontal conductive strips can be in the range of 5 to 50 mm but preferably in the range of 10 to 30 mm. The distance between the uppermost antenna strip and the defogging heater element is desirably in the range of 5 to 15 mm.

Further, with regard to the embodiments of Figs. 7 to 10, the horizontal lengths C1, C2 can be in the range of 100 to 500 mm, and the vertical length D1 can be in the range of 5 to 20 mm. Further, it is desirable to arrange the main element at a widthwise central area of the space 1*a* than at a widthwise marginal area so that a desired distance "J" between the widthwise center "CL" of the window glass 1 and the vertical conductive strip of the main element is in the range of 0 to 200 mm. Further, the horizontal length "H" of the auxiliary element can be in the range of 100 to 700 mm, and a desirable distance between the point of connection of the vertical portion of the auxiliary element to the upper horizontal strip of the main element and the closed end of the main element is within the range of 0 (in the case of embodiment of FIG. 10) to (E/2) mm. Further, a desired distance between the horizontal conductive strip of the auxiliary element and the defogging heater element is in the range of 5 to 30 mm.

Further, while the glass antenna of this invention, when used in a keyless entry system, is for exclusive use therefor, it can otherwise be used as a subsidiary antenna for an FM broadcast wave or a TV broadcast wave. In such a case, the more desirable result can be obtained when the antenna of this invention is used together with a main antenna constituted by a glass antenna provided to the upper portion of the glass plate above the defogging heater element, a glass antenna provided to the windshield, a glass antenna provided to the glass pane of the side window or a pole antenna to perform diversity reception.

Further, in the case the rear window glass is made up of a laminated glass, the glass antenna can be formed from thin metal wire such as copper wire which is embedded in an intermediate layer of polyvinyl butyral.

What is claimed is:

1. An antenna attached to a vehicle rear window glass for receiving a radio wave of a frequency f (MHz) and a wavelength λ, the window glass being provided with a defogging heater element so as to leave a space between the heater element and the lower edge of the window glass, the antenna being arranged in said space and comprising:

a main element made up of four horizontal conductive strips disposed in an area of said space between a lateral edge and a widthwise center of the window glass and having a length within the range of $0.02\lambda \cdot f^{\frac{1}{2}} \cdot x$, where x is a multiplier that is in the range of 0.8 to 1.2, said horizontal conductive strips being connected at opposite ends by vertical conductive strips so as to constitute two rectangular loops which are vertically separated from each other but connected by a vertical conductive strip at ends thereof located nearer to the lateral edge of the window glass; and a feed point disposed in an area of said space adjacent the lateral edge of the window glass and electrically connected with said horizontal conductive strips.

2. An antenna attached to a vehicle rear window glass for receiving radio waves, the window glass being provided with a defogging heater element so as to leave a space between the heater element and the lower edge of the window glass, the antenna being arranged in said space and comprising:

a main element disposed in an area of said space between a lateral edge and a widthwise center of the window glass and having two horizontal conductive strips and a vertical conductive strip connecting ends of said horizontal conductive strips;

a feed point disposed in an area of said space adjacent the lateral edge of the window glass; and an auxiliary element having a first conductive strip made up of a vertical portion extending upward from upper one of said horizontal conductive strips of said main element to have an upper end and a horizontal portion extending between said upper end of said vertical portion and said feed point;

wherein the joint between said vertical portion of said conductive strip of said auxiliary element and said upper horizontal conductive strip of said main element is spaced a predetermined distance from said end of said upper horizontal conductive strip of said main element, said horizontal conductive strips of said main element have the same length, and said auxiliary element further has a second conductive strip made up of a second vertical portion extending downward from said feed point to have a lower end and a second horizontal portion located under said main element and extending from said lower end of said second vertical portion toward the widthwise center of the window glass.

3. An antenna attached to a vehicle rear window glass for receiving radio waves, the window glass being provided with a defogging heater element so as to leave a space between the heater element and the lower edge of the window glass, the antenna being arranged in said space and comprising:

a main element disposed in an area of said space between a lateral edge and a widthwise center of the window glass and having two horizontal conductive strips and a vertical conductive strip connecting ends of said horizontal conductive strips;

a feed point disposed in an area of said space adjacent the lateral edge of the window glass; and an auxiliary element having a first conductive strip made up of a vertical portion extending upward from upper one of said horizontal conductive strips of said main element to have an upper end and a horizontal portion extending between said upper end of said vertical portion and said feed point;

wherein the joint between said vertical portion of said conductive strip of said auxiliary element and said upper conductive strip of said main element is located at said end of said upper conductive strip of said main element, said lower one of said conductive strips of said main element is longer than said upper one of said conductive strips and shorter than said horizontal portion of said first conductive strip of said auxiliary element, and said auxiliary element further has a second conductive strip extending horizontally from said end of said upper horizontal strip of said main element toward a widthwise center of the window glass, said second horizontal conductive strip of said auxiliary element being shorter than said upper horizontal conductive strip of said main element.

* * * * *